US005921843A

United States Patent [19]

Skrivan et al.

[11] Patent Number: 5,921,843

[45] Date of Patent: Jul. 13, 1999

[54] REMOTE CONTROLLED TOY VEHICLE

[75] Inventors: Joseph F. Skrivan; David J. Ribbe, both of Cincinnati, Ohio

[73] Assignee: Hasbro, Inc., Pawtucket, R.I.

[21] Appl. No.: 08/985,263

[22] Filed: Dec. 4, 1997

[51] Int. Cl.[6] ..... A63H 17/14; A63H 17/39

[52] U.S. Cl. ..... 446/433; 446/431; 446/433; 446/435; 446/465

[58] Field of Search ..... 446/456, 433, 446/431, 435, 441, 442, 443, 470

[56] References Cited

U.S. PATENT DOCUMENTS

| | | | |
|---|---|---|---|
| D. 139,803 | 12/1944 | Henry . | |
| D. 232,573 | 8/1974 | Daniel . | |
| D. 236,642 | 9/1975 | Fahrendorff . | |
| D. 252,228 | 6/1979 | Asano . | |
| D. 252,231 | 6/1979 | Asano . | |
| D. 252,291 | 7/1979 | Asano . | |
| D. 282,677 | 2/1986 | Arigaya . | |
| D. 283,235 | 4/1986 | Arigaya . | |
| D. 289,187 | 4/1987 | Ohno . | |
| D. 313,255 | 12/1990 | Honma . | |
| D. 313,823 | 1/1991 | Scheckel . | |
| D. 317,024 | 5/1991 | Yajima . | |
| D. 317,336 | 6/1991 | Tsuchiya . | |
| D. 318,081 | 7/1991 | Yoshino . | |
| D. 318,888 | 8/1991 | Yoshino . | |
| D. 362,280 | 9/1995 | George . | |
| 1,319,998 | 10/1919 | Glinka . | |
| 1,592,559 | 7/1926 | Dean . | |
| 1,669,345 | 5/1928 | Owens . | |
| 1,748,400 | 2/1930 | Sabin . | |
| 1,828,288 | 10/1931 | Marx . | |
| 1,868,313 | 7/1932 | Daubendiek . | |
| 2,064,309 | 12/1936 | Lohr . | |
| 2,244,528 | 6/1941 | Schur . | |
| 2,247,354 | 7/1941 | Berger . | |
| 2,279,386 | 9/1942 | Carver | 446/433 |
| 2,320,019 | 5/1943 | Voorhis . | |
| 2,562,264 | 3/1951 | Ford | 446/433 |
| 2,586,239 | 2/1952 | MacKenzie . | |
| 2,778,158 | 1/1957 | Ernst . | |
| 2,832,426 | 4/1958 | Seargeant . | |
| 2,898,965 | 8/1959 | Eddy . | |
| 3,120,409 | 2/1964 | Beall . | |
| 3,190,384 | 6/1965 | Dufresne . | |
| 3,263,363 | 8/1966 | Doe . | |
| 3,351,037 | 11/1967 | Meili . | |
| 3,445,959 | 5/1969 | Barlow et al. . | |
| 3,447,620 | 6/1969 | Schoonover . | |
| 3,521,527 | 7/1970 | Gies et al. . | |
| 3,688,858 | 9/1972 | Jespersen . | |
| 3,695,736 | 10/1972 | Brown . | |
| 3,726,355 | 4/1973 | Dunder . | |
| 3,747,265 | 7/1973 | Gagnon . | |
| 3,772,825 | 11/1973 | Gagnon . | |
| 3,785,085 | 1/1974 | Peroni . | |
| 3,805,912 | 4/1974 | Mattson . | |
| 3,810,515 | 5/1974 | Ingro . | |
| 3,823,790 | 7/1974 | Richison et al. . | |
| 3,869,825 | 3/1975 | Heberlein | 446/433 |
| 4,017,746 | 4/1977 | Miller . | |
| 4,112,615 | 9/1978 | Ishimoto . | |
| 4,168,468 | 9/1979 | Mabuchi et al. . | |
| 4,197,672 | 4/1980 | Mabuchi et al. . | |
| 4,198,103 | 4/1980 | Ward et al. . | |
| 4,209,942 | 7/1980 | Lohr . | |
| 4,213,269 | 7/1980 | Grogg, Sr. . | |
| 4,213,270 | 7/1980 | Oda . | |
| 4,226,292 | 10/1980 | Monte et al. . | |
| 4,231,182 | 11/1980 | Kurita . | |
| 4,300,308 | 11/1981 | Ikeda . | |
| 4,306,630 | 12/1981 | Monte et al. . | |
| 4,385,466 | 5/1983 | ReVelle . | |
| 4,406,085 | 9/1983 | Rhodes . | |
| 5,135,427 | 8/1992 | Suto | 446/433 |
| 5,261,853 | 11/1993 | Suto | 446/433 |
| 5,484,321 | 1/1996 | Ishimoto | 446/433 |
| 5,597,165 | 1/1997 | Rundle | 273/442 |
| 5,727,985 | 3/1998 | George | 446/437 |
| 5,803,790 | 1/1997 | Tilbor | 446/470 |

*Primary Examiner*—Kien T. Nguyen
*Assistant Examiner*—Kurt Fernstrom
*Attorney, Agent, or Firm*—Fish & Richardson P.C.

[57] ABSTRACT

A remote controlled, all-terrain toy vehicle has treads on both its left and right sides. Each tread extends over front and rear oversized, resilient wheels that allow the vehicle to travel on its top and bottom sides in forward and reverse. The vehicle is adapted for high performance on hard, flat surfaces, such as pavement, as a result of an elevated ridge on the tread that ensures low surface area contact with the ground and, which in turn, reduces ground resistance and increases the operating speed of the vehicle.

29 Claims, 16 Drawing Sheets

REMOTE CONTROLLED TOY VEHICLE

TECHNICAL FIELD

The invention relates to remote controlled toy vehicles.

BACKGROUND INFORMATION

Remote controlled toy vehicles operate in response to signals from a handheld remote control. The vehicles may be adapted to operate at high speeds or over rough terrain. Some such vehicles include treads encircling the wheels of the vehicle.

SUMMARY

In general, the invention provides wheels and treads, or belts, for a remote controlled toy vehicle. The wheels are oversized and extend beyond the top, bottom, front and rear of the vehicle so that the wheel and tread arrangement allows the vehicle to travel in forward and reverse on its top and bottom sides on many types of terrain. The tread or belt extends between the front and rear wheels. One or more motors power the rear wheels, which in turn drive the tread. Use of the tread gives the vehicle more surface area for traction on soft or uneven terrains. To ensure that the tread and wheels do not separate, the tread's interior surface defines recessed tracks in which the wheels travel.

In one general aspect, the invention features a toy vehicle that includes a body, first and second front wheels rotatably attached to the body, and first and second rear wheels rotatably attached to the body. Treads extend between the front and rear wheels. The wheels and treads are sized and positioned relative to the body so that the treads define a maximum outer perimeter of the toy vehicle. Since the treads define an outer perimeter of toy vehicle, the toy vehicle can travel when the body is in an upright (i.e., top up) configuration or an inverted (i.e., top down) configuration. This permits the toy vehicle to be operated under a variety of conditions.

Embodiments may include one or more of the following features. For example, each of the wheels may have a diameter greater than a height of the body, and the front and the rear wheels may extend, respectively, beyond the front and the rear of the body.

The toy vehicle may include a receiver, such as, for example, a radio or infrared receiver, positioned in the body, and a motor configured to provide power to at least one of the wheels. The receiver may be configured to receive signals from a remote control device and to control the motor in response to the signals.

At least one of the treads may include an interior circumferential surface and elements extending from the interior surface to define a recessed track in which at least a portion of at least one wheel travels. The track may be defined by multiple elements on opposite sides of the tread. The elements may be configured to engage at least one of the wheels. For example, at least one of the wheels may includes cogs that are engaged by the elements. The cogs may be positioned in two or more rows that run longitudinally along the circumference of the wheel.

At least one of the wheels may include tiers running longitudinally along the circumference of the wheel, and at least one of the tiers may travel within the track defined by the tread. The tiers may consecutively decrease in diameter from the center-most tier moving outward.

At least one of the treads may include a ridge running longitudinally along an exterior surface of the tread. The ridge may be centered on the exterior surface of the tread. The ridge is elevated from the tread. When the vehicle travels on hard, flat surfaces, the ridge is the only portion of the belt that contacts the ground. This reduces resistance between the ground and the tread. A radius on the ridge reduces the turning resistance of the tread on hard, flat surfaces and permits the vehicle to turn more easily.

The tread also may include ribs running transversely along the width of the tread and extending beyond an exterior surface of the tread. The elevated ribs stiffen the tread to prevent the tread from separating from the wheels. The ribs also provide traction benefits when the vehicle travels over soft or uneven surfaces. The ribs are elevated above the base of the tread's exterior surface, but the ribs' elevation is lower than that of the ridge so as to maintain the reduced resistance achieved by the ridge on hard, flat surfaces.

If desired, either for aesthetic or functional purposes, additional patterns may be placed on the exterior surface of the belt. Whether those patterns are aesthetic or functional will depend largely on the amount of power driving the wheels relative to the increased resistance created by the patterns.

The interior surface of the tread, which is in contact with the resilient wheels, may have a series of stair-shaped elements along the outer edges of the tread. The elements ensure that the wheels transfer power to the tread. In the event that the wheels were to begin slipping with respect to the tread, portions of the elements would engage the cogs on one or more of the wheels to ensure power transfer. The elements also define at least one recessed track on the interior surface of the belt in which the wheels travel. This recessed track prevents the belt from sliding off of the wheels in a direction perpendicular to wheel movement.

The wheels of the vehicle may be oversized and resilient. Resilient wheels allow the vehicle to bounce, absorb shock, and provide high speed response when it meets obstacles that create opposing forces. The bounciness gives the toy high entertainment value and allows the vehicle to seek the path of least resistance.

The wheels may be oversized to the extent that they allow the vehicle to flip end over end and travel on either its top or bottom sides. When the diameter of each wheel is greater than the height of the body of the vehicle, the toy can travel on its top and bottom sides. To allow the car to flip end over end, the rear wheels extend behind the rear of the vehicle and the front wheels extend in front of the vehicle.

The wheels may include tiered surfaces, with the tiers being defined by concentric circles of varying diameter along the circumference of the wheel. For example, the center of the wheels may include increased diameter portions that fit within the recessed track on the interior surface of the tread to prevent the tread from separating from the wheels. The tiers also provide some rigidity to the wheels, while maintaining their resiliency.

The wheels may include cogs that ensure the driving power of the wheels transfers to the belt. As noted above, the cogs engage the elements of the belt if the wheels begin to slip relative to the belt.

The vehicle may also include a third wheel on each of its sides. The diameter of the third wheel is considerably less than that of the front and rear wheels so that only the bottom portion of the wheel contacts the tread. At least one of the third wheel's tiers may travel within a recessed track on the interior surface of the tread. This reduces the amount of resistance the third wheel places on the tread while maintaining the tread on the wheels. The third wheel extends slightly below the other wheels so that the third wheel can serve to place the weight of the vehicle on a central point under the center of gravity of the vehicle, so as to unload other points of the tread and allow the vehicle to turn or spin freely.

The vehicle may have a turret including a mechanism for launching projectiles. The turret may be remotely or manually controlled to turn angularly or to move the projectile-launching mechanism up and down. The projectile-launching mechanism also may be remotely controlled.

In another general aspect, the invention features a toy vehicle that includes a body, a front wheel rotatably attached to the body, a rear wheel rotatably attached to the body, and a tread extending between the front wheel and the rear wheel. The tread includes an interior circumferential surface and elements extending from the interior surface to define a recessed track in which at least a portion of at least one wheel travels. Embodiments may include one or more of the features described above.

Other features and advantages of the invention will become apparent from the following detailed description, including the drawings, and from the claims.

DETAILED DESCRIPTION

Figure 1:
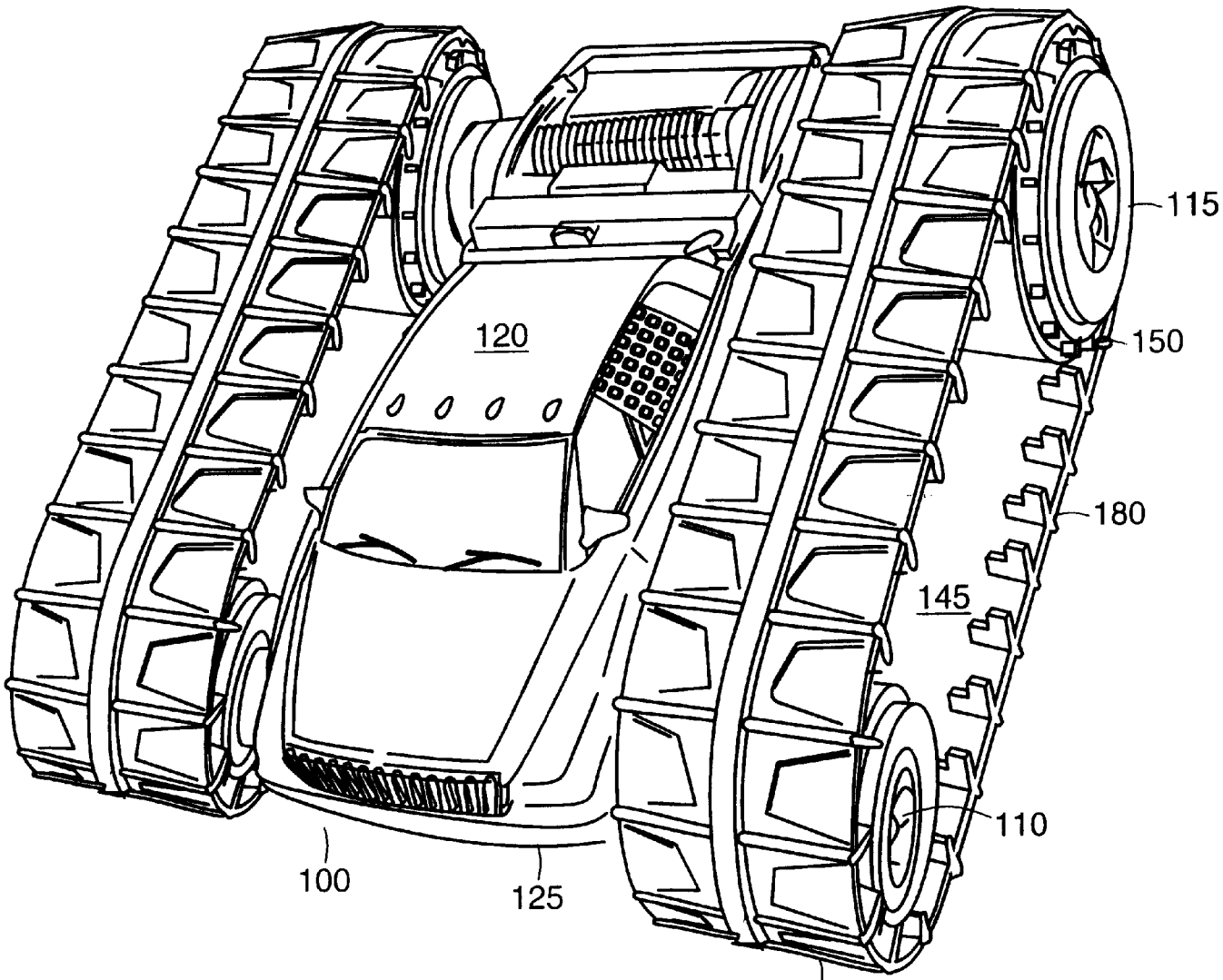
FIG. 1 is a perspective view of a remote controlled all-terrain vehicle.
Figure 2:
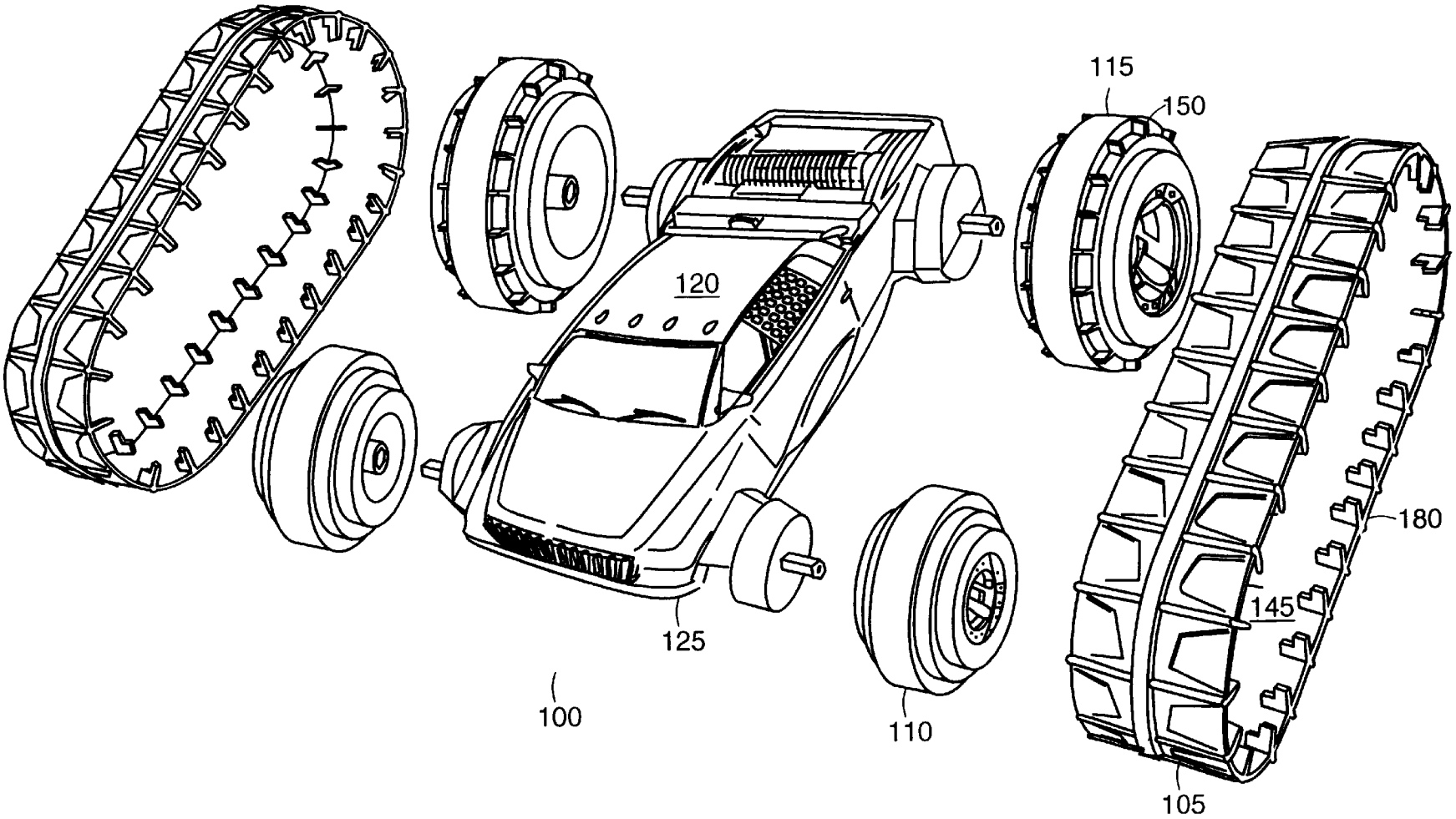
FIG. 2 is a perspective assembly view of the vehicle in FIG. 1.

Referring to FIGS. 1 and 2, a remote controlled toy 100 is designed to operate over any terrain. To this end, the toy 100 includes a tread 105, and front 110 and rear 115 wheels on each of its sides. The wheels 110, 115 are oversized and resilient. The rear wheel 115 drives the tread 105, which wraps around both the front and rear wheels. The oversized wheels 110, 115 and the tread 105 permit the toy 100 to move forward and backward on either its top 120 or bottom 125 sides. Further, because of their resiliency, the wheels 110, 115 and the tread 105 provide highly responsive bouncing action when they meet obstacles that create an opposing force. The bouncing action provides entertainment value and allows the toy to bounce to the path of least resistance, thereby increasing the speed with which the toy travels. In addition to performing well on uneven or soft surface terrains, the tread is designed to reduce resistance when in contact with hard surfaces, which allows the toy to turn more easily.

Figure 3:
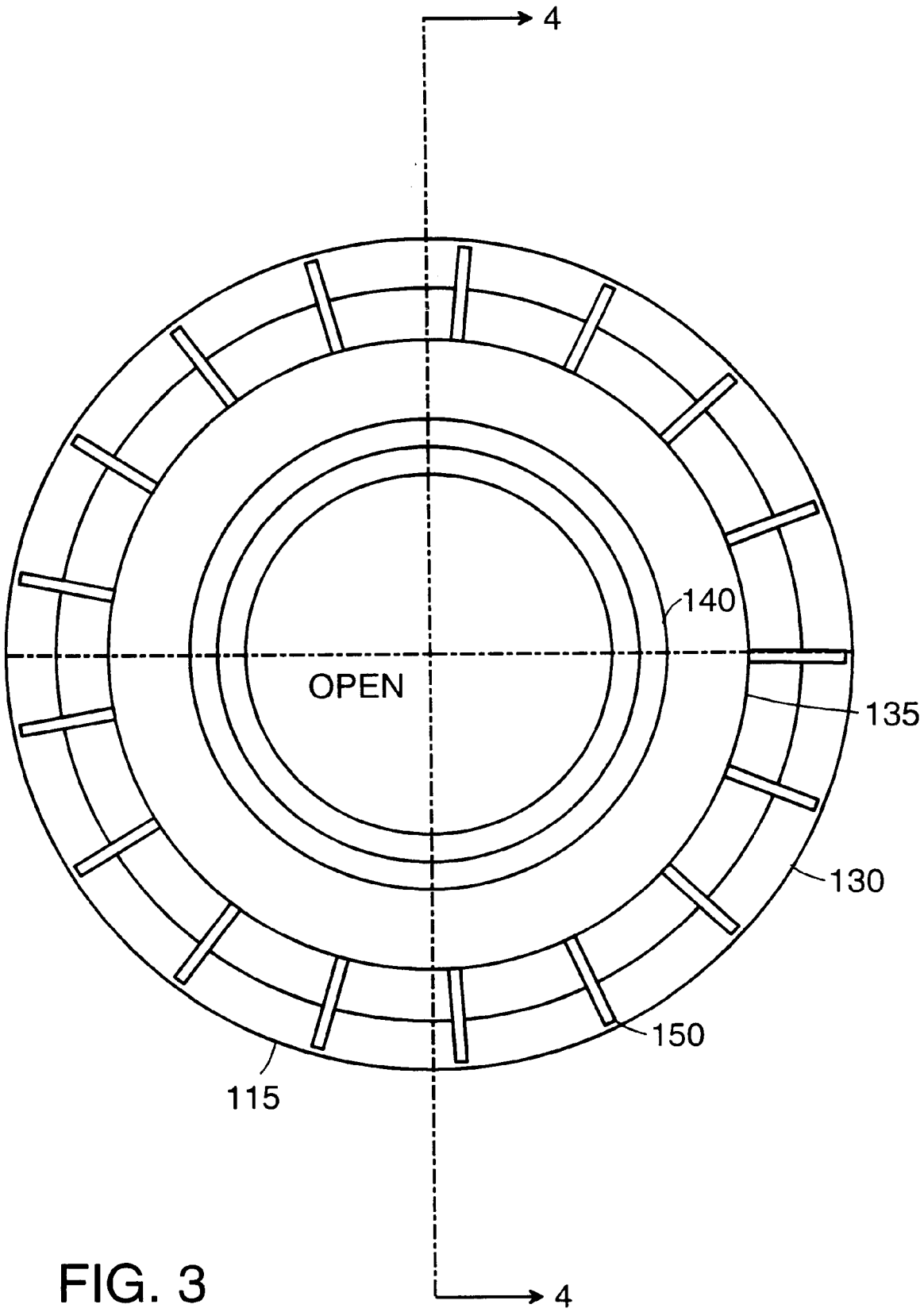
FIG. 3 is a side view of the rear wheel of the vehicle in FIG. 1.
Figure 4:
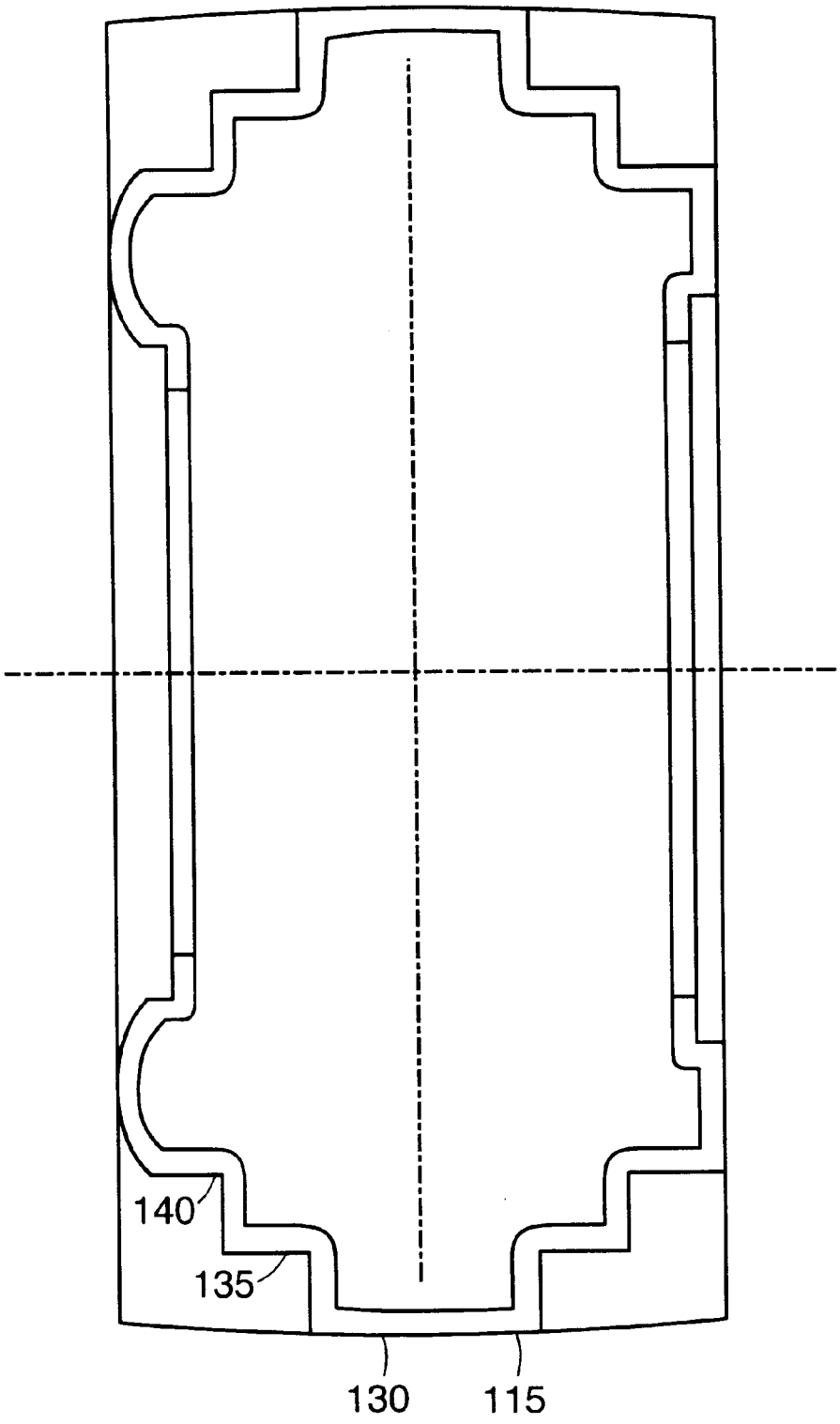
FIG. 4 is a cross sectional view taken along line 4—4 of FIG. 3.

FIGS. 3 and 4 show that the hollow rear wheel 115 has three tiers: the outer tier 130, the middle tier 135, and the inner tier 140. As discussed below, the outer tier 130 and middle tier 135 travel within the tracks formed on the tread's interior surface 145 (FIGS. 1 and 2). This prevents the tread from separating from the wheel.

In addition to fitting within the tracks of the tread, the tiers of the wheels affect the resiliency of the wheels. This resiliency causes high rebounding action upon impact with an obstacle and allows the toy to seek the path of least resistance.

Referring also to FIGS. 1 and 2, the rear wheel's middle tier 135 has a plurality of cogs 150 that run transversely along the surface of the middle tier 135 and extend outward and perpendicularly to the wheel's circumference. The height of the cogs 150 approximates the height between the middle tier 135 and the outer tier 130. As discussed below, the cogs 150 ensure that the driving power of the rear wheel transfers to the tread.

Figure 5:
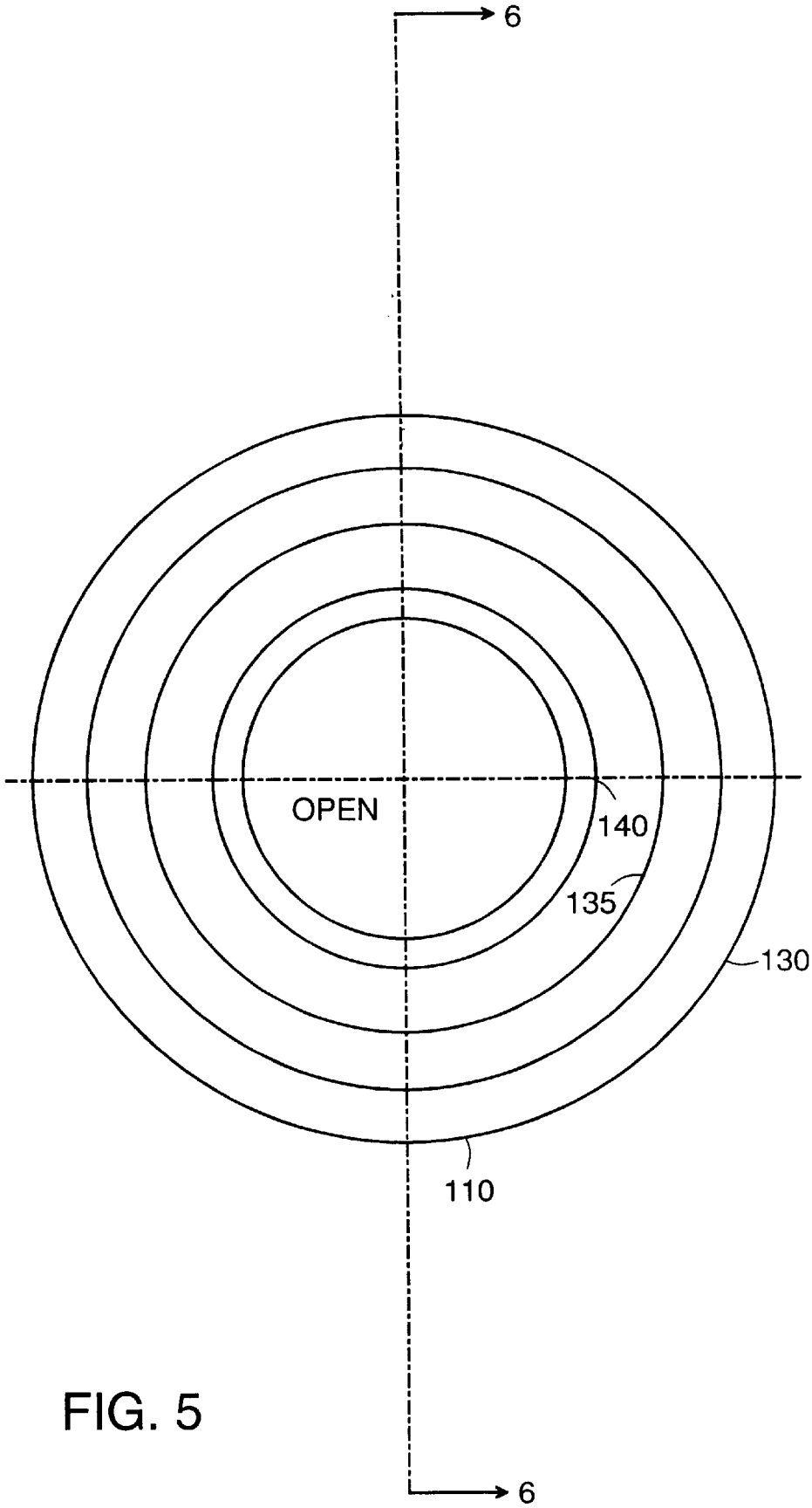
FIG. 5 is a side view of the front wheel of the vehicle in FIG. 1.
Figure 6:
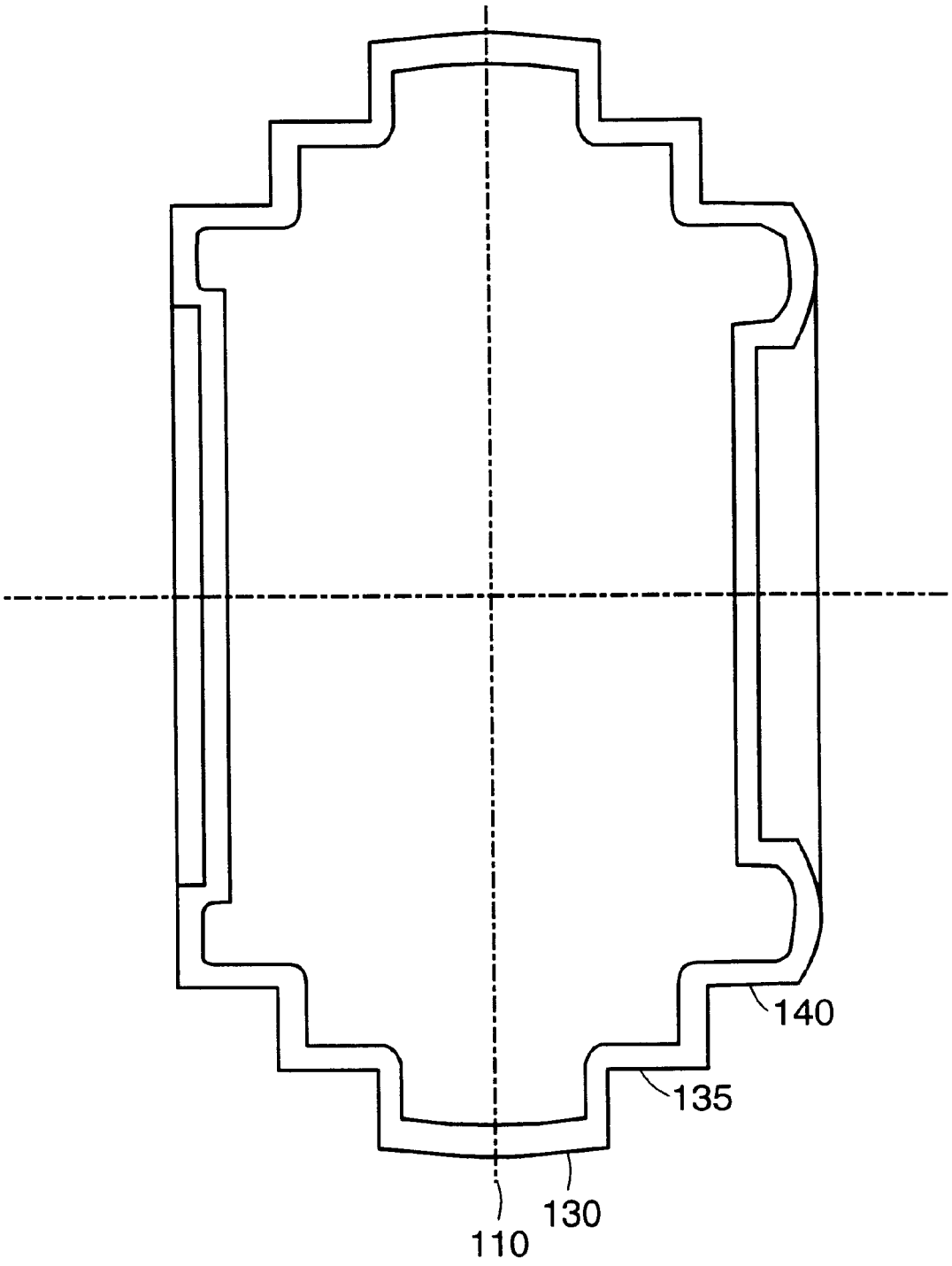
FIG. 6 is a cross sectional view taken along line 6—6 of FIG. 5.

Referring also to FIGS. 5 and 6, the front wheels 110 also have three tiers that serve to hold the tread on the wheels and ensure resiliency: the outer tier 130, the middle tier 135, and the inner tier 140. The front wheels have shorter diameters than the rear wheels.

Unlike the rear wheels 115, the front wheels 110 do not have cogs. The absence of the cogs allows the tread to travel more easily over the front wheels by reducing resistance.

FIG. 1 illustrates that both the front wheels and the rear wheels have diameters greater than the toy's body and extend beyond the ends of the toy's body. This configuration permits the toy to flip end over end and travel on either its top or bottom sides without having the body of the toy contact the ground.

Extending between the front and rear wheels, the tread 105 increases the surface area of the toy that is in contact with the ground, and thereby allows for better traction. The tread 105 also allows the toy to maneuver around obstacles that other toys may not be able to overcome.

Figure 7:
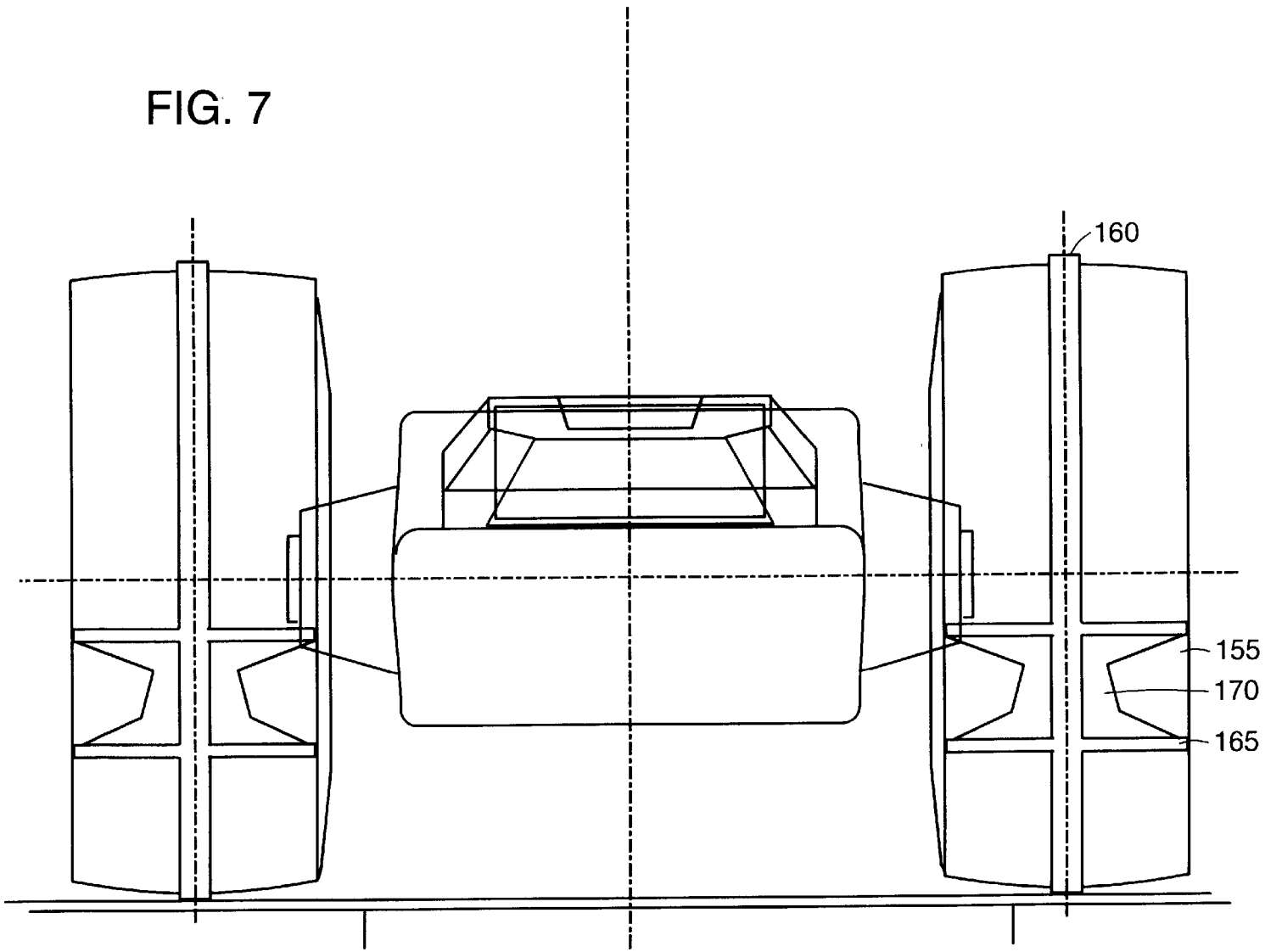
FIG. 7 is a front view of the vehicle in FIG. 1.
Figure 8:
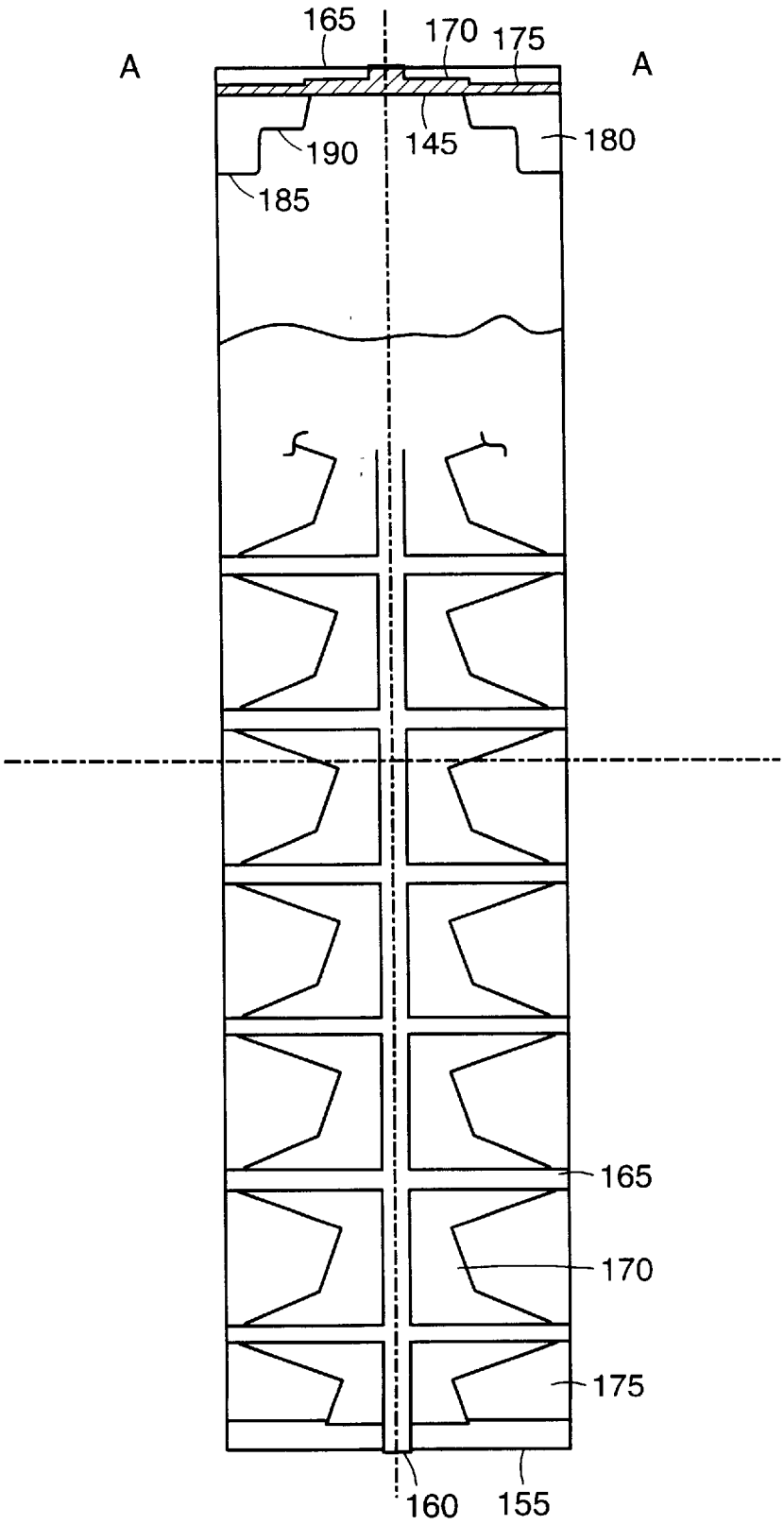
FIG. 8 is a partial front view and partial sectional view of the tread of the vehicle in FIG. 1.

Referring also to FIGS. 7 and 8, the tread's exterior surface 155 includes an elevated center ridge 160 that runs longitudinally down the center of the tread 105. The ridge 160 includes curved edges. As shown in FIG. 7, this ridge 160 is the only portion of the tread 105 that comes in contact with the ground when the toy travels on flat, hard surfaces. Due to the reduced friction resulting from the reduced surface area contacting the ground and the curvature of the edges of the ridge, the toy turns more quickly on hard surfaces.

The tread's exterior surface 155 has ribs 165 that run along the tread perpendicular to the ridge 160. The ribs 165 serve to increase the tread's 105 rigidity so as to prevent separation of the tread from the wheels 110, 115. The ribs 165 also serve to enhance traction on loose or uneven surfaces.

The tread's exterior surface 155 also includes an aesthetic portion 170 that serves primarily to enhance the aesthetic features of the tread, and also provides some additional traction on loose or uneven surfaces. As shown in FIG. 8, this portion of the tread is elevated slightly above the tread's bottom portion 175, but is below the ridge 160 and rib 165. The aesthetic portion of the tread is raised only minimally to maintain low resistance and increase running and turning speeds.

The tread's interior surface 145, as seen in FIGS. 1, 2, and 8, prevents the tread 105 from separating from the wheels 110, 115, and ensures that the driving power of the wheels transfers to the tread. The interior surface 145 of the tread includes two-tiered fittings 180 positioned on opposing ends of the interior surface 145 and directly below the ribs 165 of the tread's exterior surface 155.

The fittings 180 create tracks on the tread's interior surface to prevent the tread from separating from the wheels. The fittings 180 also meet with cogs 150 on the rear wheel 115 to ensure that the rear wheel's driving force transfers to the tread.

As shown in FIG. 8, the outward end portion 185 of the fitting runs perpendicularly inward from the interior surface of the tread. Referring also to FIGS. 3–6, the length of the fitting's outward end portion 185 is greater than the length between the outer tier 130 and the middle tier 135 of the front and rear wheels. The width of the fitting's outward end portion 185 is less than the width of the exterior-most, inner tier 140 of the front and rear wheels. As can be seen, the length and width of the outer end portion 185 of the fitting create a track in which the middle tier 135 and the outer tier 130 of the front and rear wheels run. This track maintains the tread on the wheels.

As best shown in FIG. 8, the inward portion 190 of the fitting 180 creates a second inner track in which the wheels travel, and ensures the driving force of the rear wheels transfer to the tread. As best shown in FIGS. 4–6, the width of the inward portion 190 is greater than the width of the middle tier 135 of the front and rear wheels. The length of the inward portion 190 is less than the length between the middle 135 and the outer 130 tiers of the front and rear wheels. To ensure that the wheels and tread do not separate, the fitting's inward portion 190 creates a second track in which the outer tier 130 of the front and rear wheels travel.

The fitting's inward portion 190 also prevents the rear wheel 115 from slipping relative the tread. The inward portion 190 of the fittings travel between the cogs 150 of the rear wheel 115. In the event that the rear wheel 115 begins to slip relative to the tread 105, the fitting's inward portion 190 catches on the cog 150 of the rear wheel to minimize the loss of power.

Figure 9:
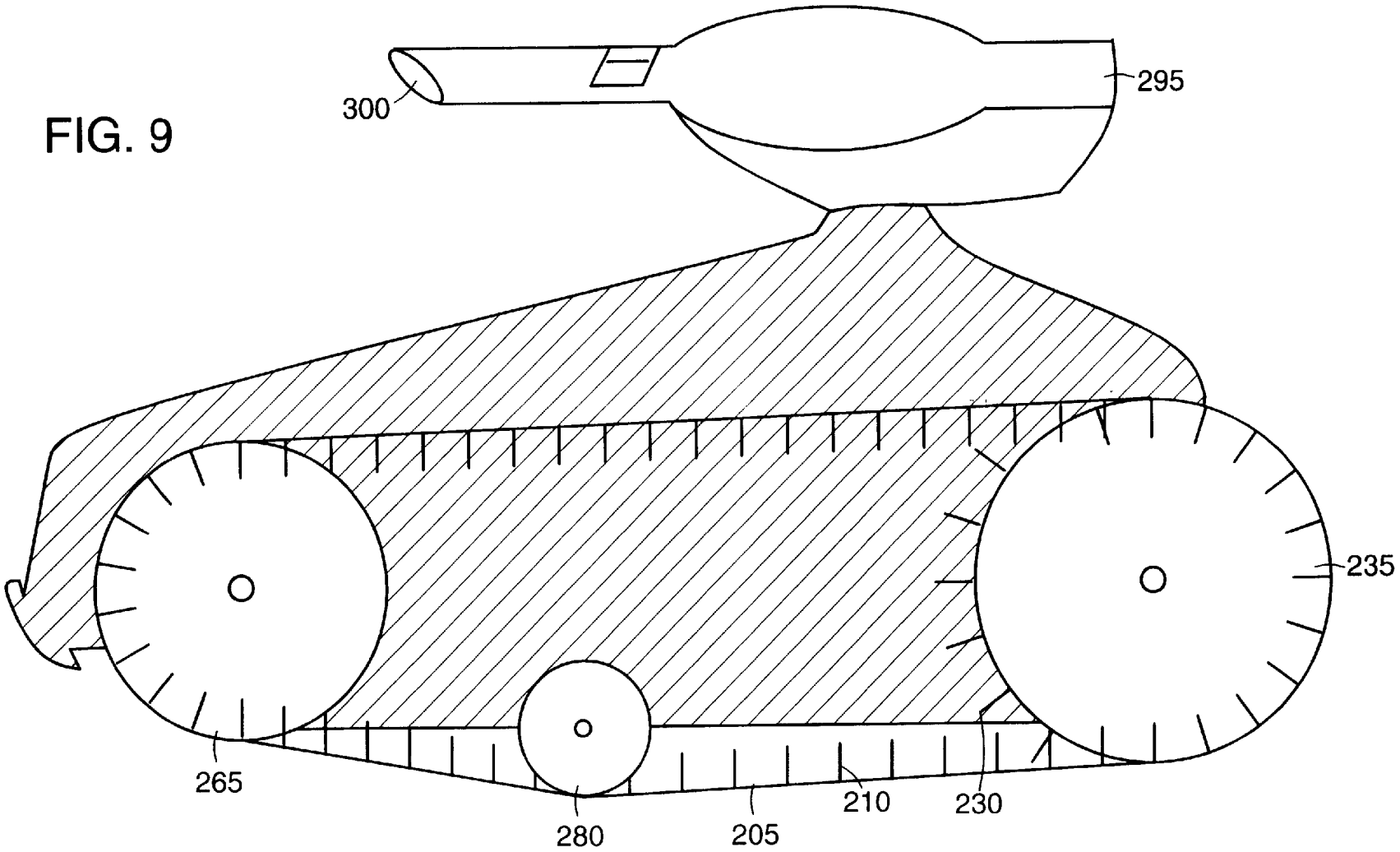
FIG. 9 is a perspective view of another embodiment of a remote controlled all-terrain vehicle.
Figure 12:
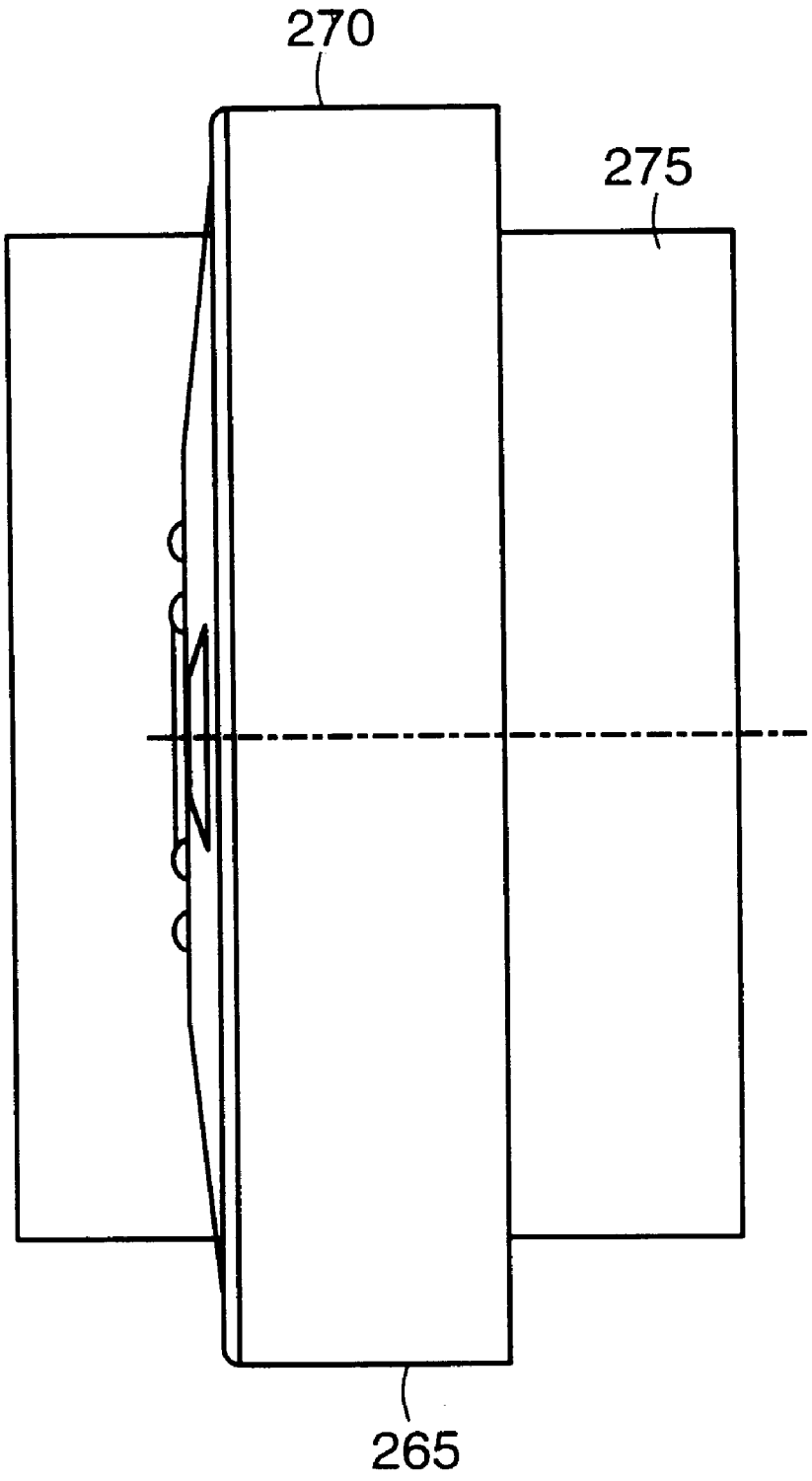
FIG. 12 is a front view of the front wheel of the vehicle in FIG. 9.
Figure 13:
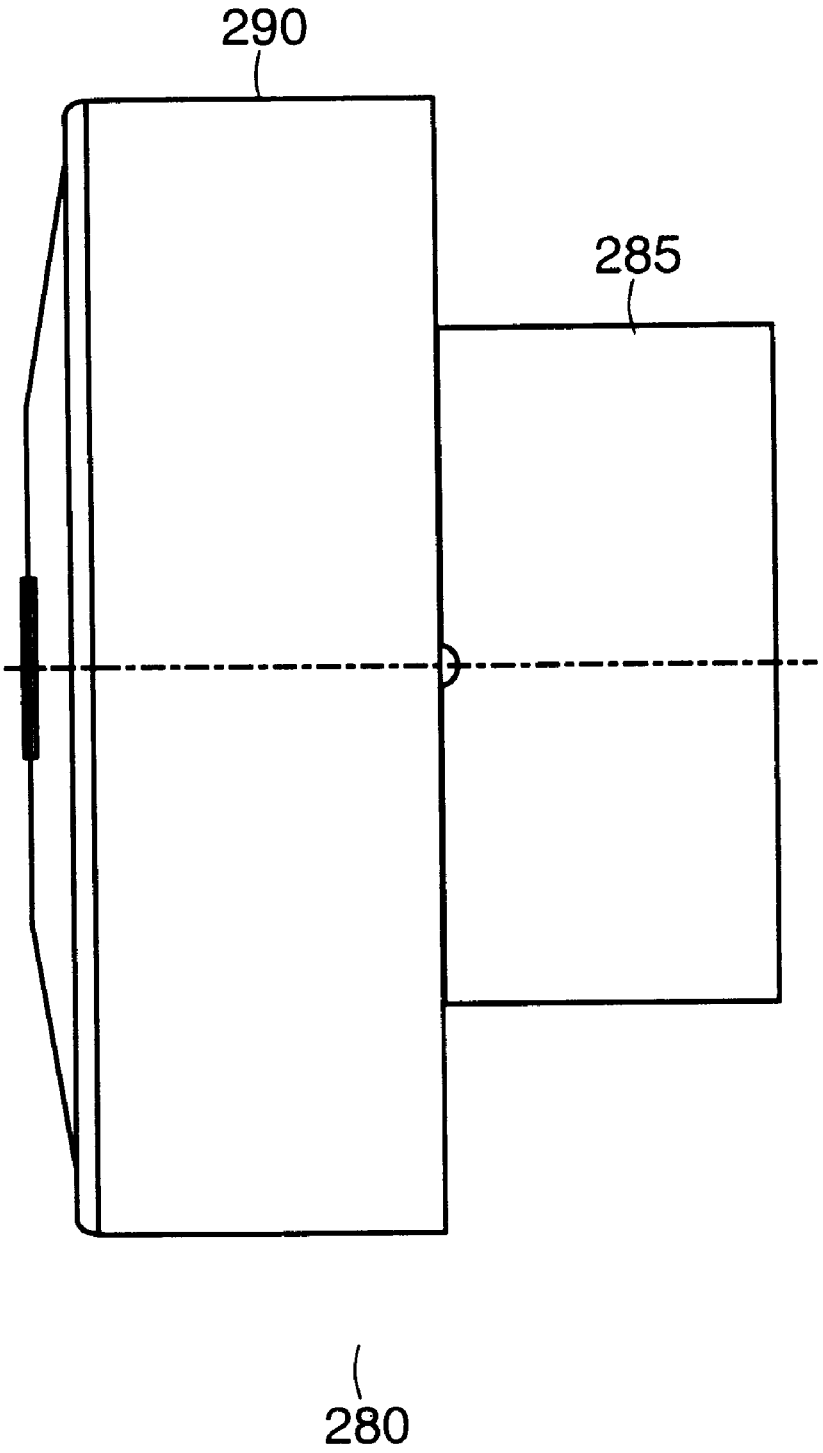
FIG. 13 is a front view of the middle wheel of the vehicle in FIG. 9.
Figure 14:
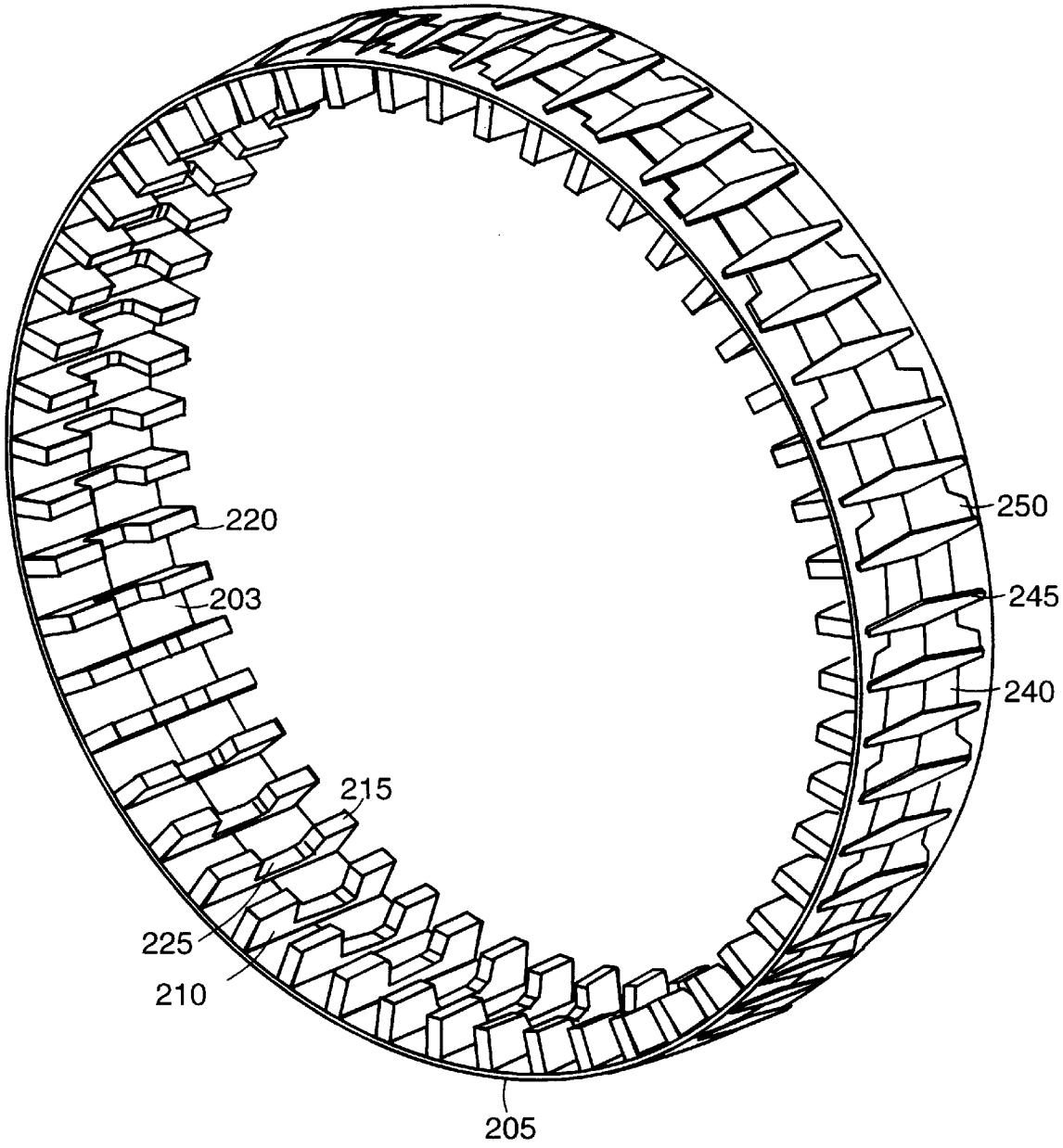
FIG. 14 is a perspective view of the tread of the vehicle of FIG. 9.
Figure 15:
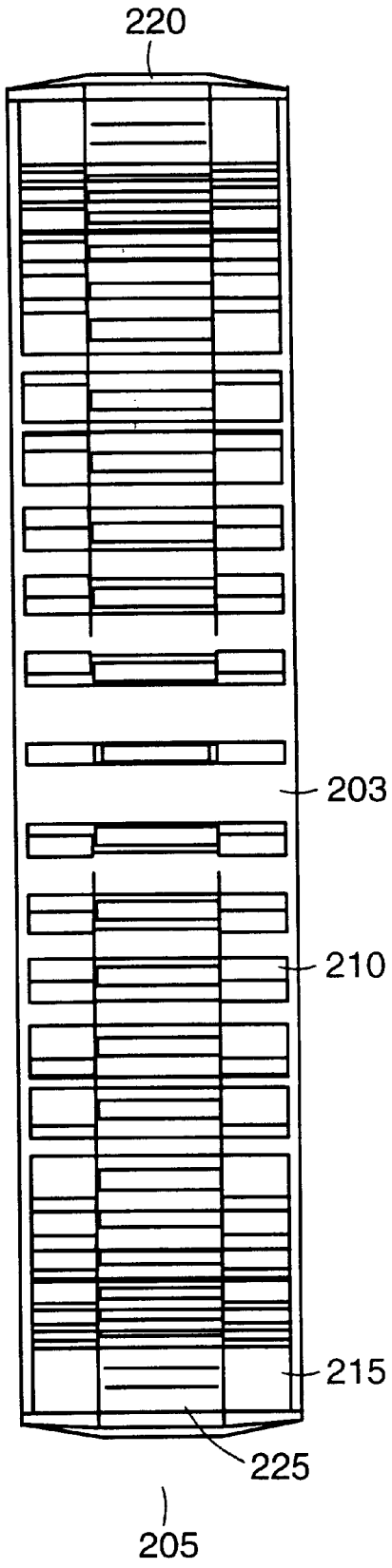
FIG. 15 is a cross sectional view of the tread of FIG. 14.
Figure 16:
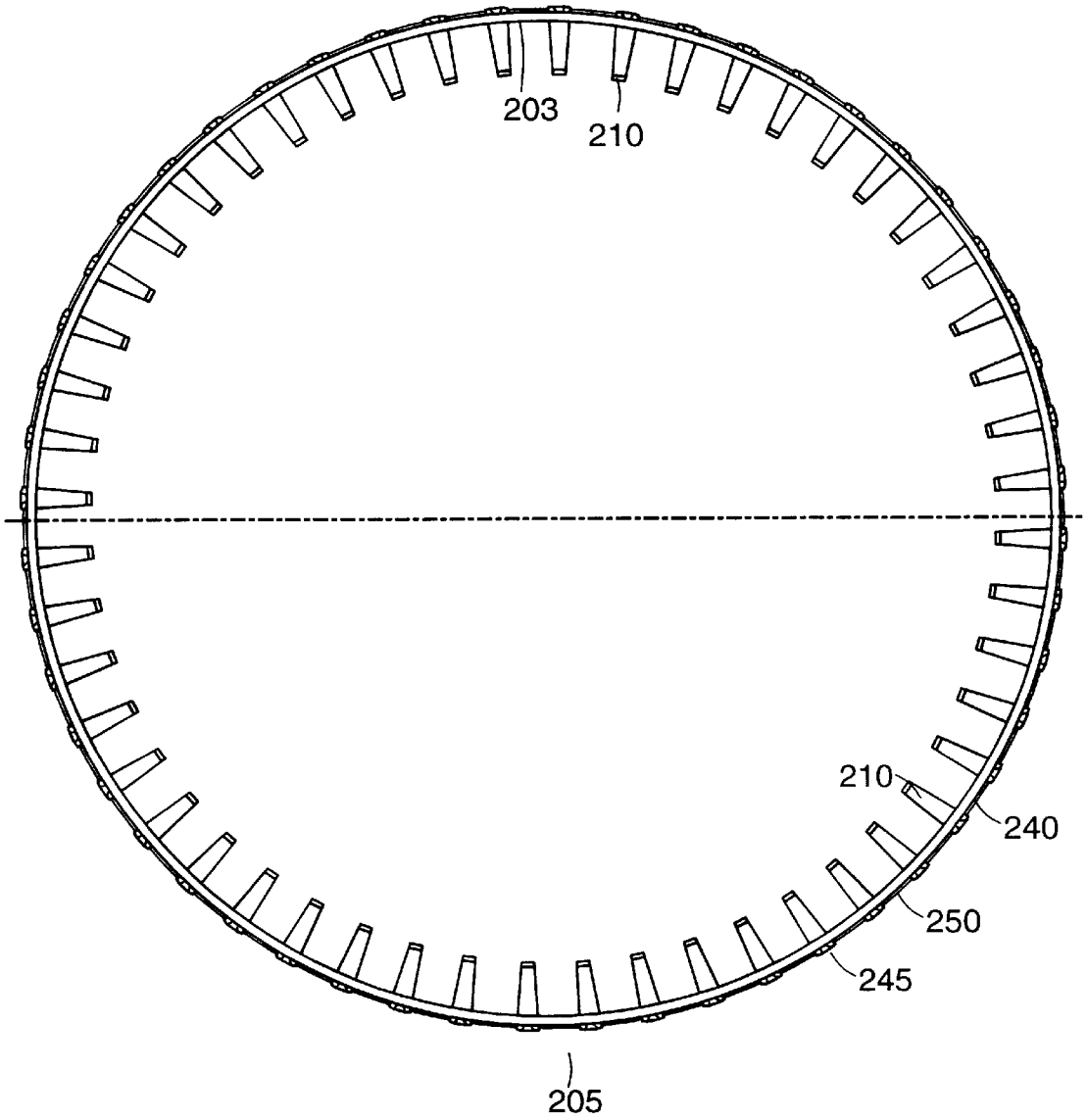
FIG. 16 is a side view of the tread of FIG. 14.

FIGS. 9–16 illustrate toy 200 having three wheels on each of its sides. Referring to FIG. 9, the toy 200 includes a tread encircling the wheels, and a barrel that fires projectiles when signaled by a remote control. FIGS. 9–13 show the front, middle and rear wheels of the toy 200, while FIGS. 14–16 show the tread that extends around the front, middle and rear wheels.

The interior surface 203 of the tread 205 includes fittings 210 that extend transversely along the width of the tread. On the fitting's 210 opposing outer edges are leg portions 215. The leg portions 215 of the fitting extend inward and perpendicularly to the tread's interior surface. The leg portions create a track 220 in which the outer tier of the front, middle and rear wheels travel. This track 220 prevents the tread from separating from the wheels.

As best shown in FIG. 14, the rib portion 225 of the fitting 210 extends between the opposing leg portions 215. As shown also in FIGS. 10 and 11, the rib portion 225 engages the cogs 230 of the rear wheel 235 to ensure that the driving power of the rear wheel transfers to the tread. In the event that the rear wheel were to begin to slip relative to the tread, the rear wheel's cogs 230 catch the fitting's rib portion 225 to ensure proper power transfer. The fitting 210 also provides rigidity to the tread, which prevents the tread from separating from the wheels.

FIGS. 14–16 illustrate the exterior surface 240 of the tread, which is designed for traction and aesthetic purposes. The paddle 245 is an elongated diamond that extends transversely along the width of the exterior surface 240 of the tread. The exterior surface 240 also includes an aesthetic portion 250 that extends between the paddles 245. As best illustrated in FIG. 16, the paddle 245 is elevated above the aesthetic portion 250, and it provides traction on uneven and loose surfaces. The aesthetic portion 250 is designed to enhance the aesthetic features of the tread, but it also provides some additional traction benefits on loose or uneven surfaces. The aesthetic portion 250 is elevated only minimally to maintain the tread's low resistance and increase running and turning speeds.

Figure 10:
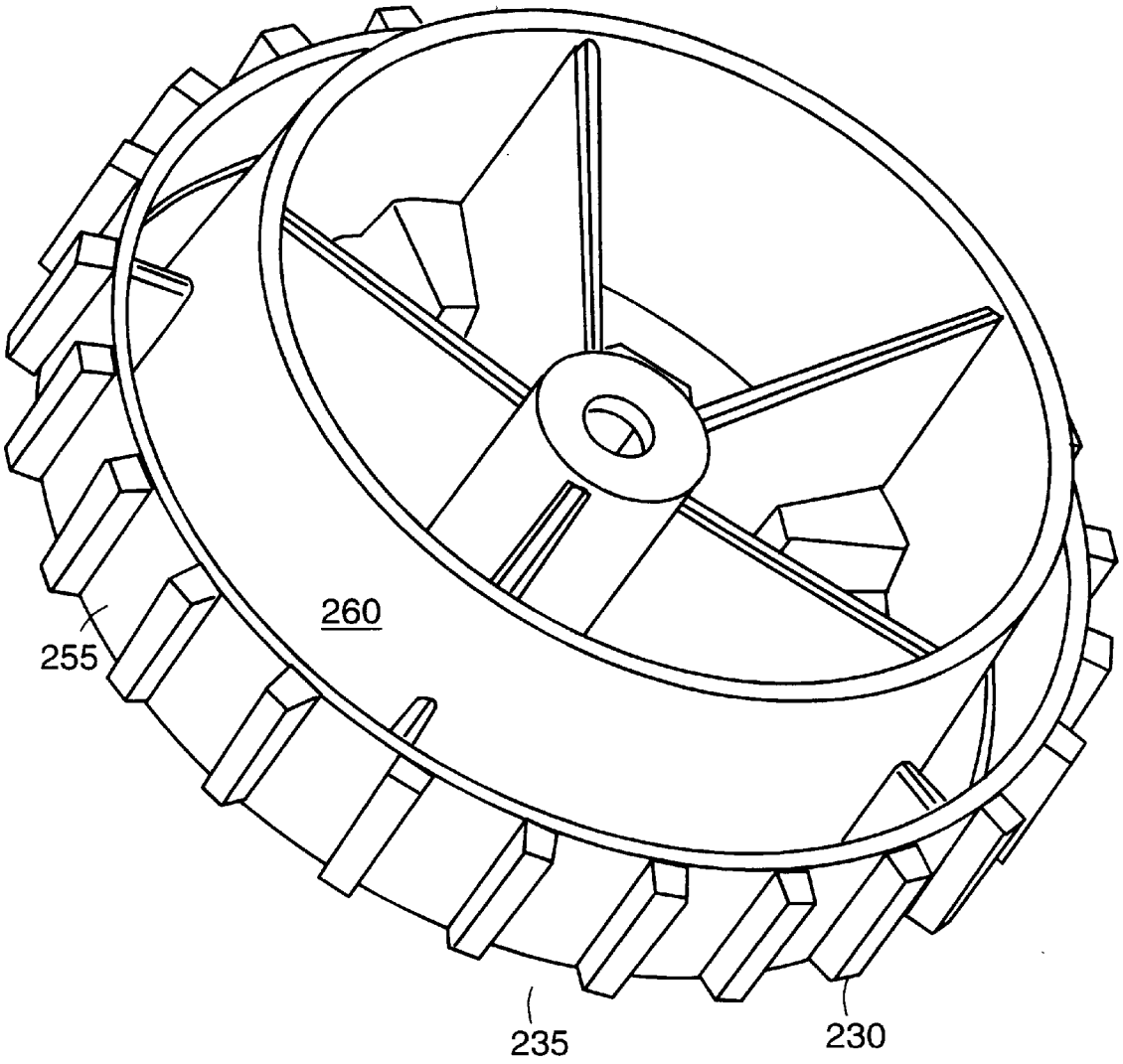
FIG. 10 is a perspective view of the rear wheel of the vehicle in FIG. 9.
Figure 11:
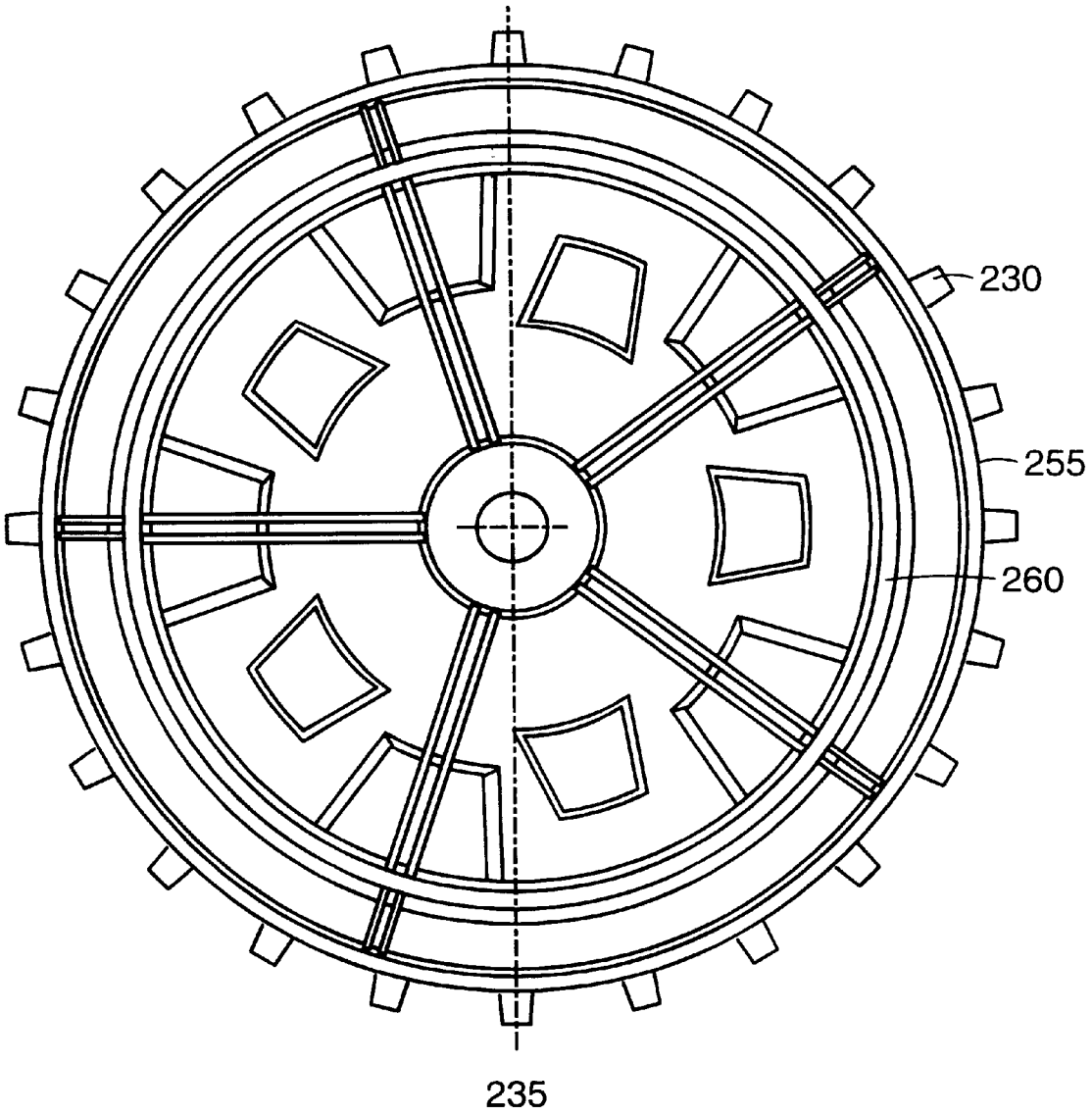
FIG. 11 is a side view of the rear wheel of FIG. 10.

FIGS. 10 and 11 show the rear wheel 235. The rear wheel includes an outer tier 255 having cogs 230. The cogs 230 run transversely along the surface of the outer tier, and extend outward, perpendicularly to the wheel's circumference. Referring also to FIG. 14, the cogs 230 engage the rib portion 225 of the interior surface 203 of the tread 205 to ensure that the rear wheel 235 does not slip relative to the tread.

The outer tier 255 of the rear wheel 235 travels within a track 220 created on the tread's interior surface 255 between the opposing leg portions. This prevents the tread from separating from the rear wheel.

The rear wheel also has an inner tier 260 located on the side of the wheel closest to the vehicle's body. The inner tier 260 bottoms on the leg portions 215 of the tread's fittings 210. This provides lateral stability to the toy, and transfers additional driving power from the rear wheel to the tread.

As shown in FIG. 12, the front wheel 265 has two tiers: the outer tier 270 and the inner tier 275. Unlike the rear wheel, however, the surface of the front wheel's outer tier 270 is smooth and lacks cogs. Without the cogs, the outer tier 270 travels within the track 220 on the tread's interior surface with less resistance.

The front wheel's inner tier 275 is located on the side closest to the body of the vehicle. Unlike the rear wheel's inner tier 260, the inner tier of the front wheel does not constantly bottom on the tread's leg portions 215. The lack of contact between the inner tier 275 and the tread's leg portions 215 maintains low resistance as the tread travels around the front wheel 265. Nevertheless, the diameter of the inner tier 275 is such that if a certain amount of localized pressure is placed on the tread directly below the inner tier 275, the surface of the inner tier bottoms on the leg portion 215, thereby increasing stability.

FIG. 13 shows the middle wheel 280 of the toy 200 with two tiers: the inner tier 285 and the outer tier 290. The middle wheel is fixed to the vehicle between the front and rear wheels, but the axis around which the third wheel rotates is placed lower, closer to the ground, on the body than the front and rear wheels. Additionally, the diameter of the middle wheel's outer tier 290 is considerably less than the diameter of the front and rear wheels' outer tiers. Only the bottom portion, therefore, of the middle wheel's outer tier 290 contacts the tread. This reduces resistance between the tread and the middle wheel.

Like the front wheel, the surface of the outer tier is smooth and lacks cogs. The smooth surface maintains low resistance between the middle wheel and the tread.

As also shown in FIG. 14, the width of the outer tier 290 of the middle wheel approximates the width of the track 220 created by the leg portions 215 of the fittings. The outer tier of the middle wheel ensures that the tread does not separate from the wheels. Additionally, the outer tier maintains tension in the tread to prevent the tread and wheels from separating.

The middle wheel's inner tier 285 is located on the side closest to the body of the vehicle. The diameter of the inner tier 285 is short enough that it does not contact the leg portions 215 on the interior surface 203 of the tread. This lack of contact maintains low resistance between the tread and middle wheel, thereby increasing the vehicle's operating speed.

As FIG. 9 illustrates, the toy 200 has a turret 295 that shoots projectiles. Using a remote control, the toy's operator signals the toy to aim the barrel 300 of the turret. The operator can then command the toy to fire a projectile out of the barrel 300.

Other embodiments are within the scope of the following claims.

What is claimed is:

1. A toy vehicle comprising:

a body;

first and second front wheels rotatably attached to the body;

first and second rear wheels rotatably attached to the body;

a first tread extending between the first front wheel and the first rear wheel; and a second tread extending between the second front wheel and the second rear wheel;

wherein the wheels and treads are sized and positioned relative to the body so that the treads define a maximum outer perimeter of the toy vehicle and permit the vehicle to travel when the body is in an upright configuration and when the body is in an inverted configuration, and at least one of the treads includes a ridge running longitudinally along an exterior surface of the tread and extending beyond all other portions of the tread.

2. The toy vehicle of claim 1, wherein each of the wheels has a diameter greater than a height of the body.

3. The toy vehicle of claim 2, wherein the front and the rear wheels extend, respectively, beyond the front and the rear of the body.

4. The toy vehicle of claim 1, wherein the front and the rear wheels extend, respectively, beyond the front and the rear of the body.

5. The toy vehicle of claim 1, further comprising:

a receiver positioned in the body, and a motor configured to provide power to at least one of the wheels, wherein the receiver is configured to receive signals from a remote control device and to control the motor in response to the signals.

6. The toy vehicle of claim 1, wherein at least one of the treads includes an interior circumferential surface and elements extending from the interior surface to define a recessed track in which at least a portion of at least one wheel travels.

7. The toy vehicle of claim 6, wherein the track is defined by a plurality of elements on opposite sides of the tread.

8. The toy vehicle of claim 6, wherein the elements are configured to engage at least one of the wheels.

9. The toy vehicle of claim 8, wherein at least one of the wheels includes cogs that are engaged by the elements.

10. The toy vehicle of claim 9, wherein the cogs are positioned in two or more rows that run longitudinally along the circumference of the wheel.

11. The toy vehicle of claim 6, wherein at least one of the wheels includes a plurality of tiers running longitudinally along the circumference of the wheel, and at least one of the tiers travels within the track defined by the tread.

12. The toy vehicle of claim 11, wherein the tiers consecutively decrease in diameter from the center-most tier moving outward.

13. The toy vehicle of claim 1, wherein the ridge is centered on the exterior surface of the tread.

14. The toy vehicle of claim 1, wherein at least one of the treads further comprises a rib running transversely along the width of the tread and extending beyond an exterior surface of the tread.

15. The toy vehicle of claim 1, wherein the wheels are resilient.

16. A toy vehicle comprising:

a body;

a front resilient wheel rotatably attached to the body;

a rear resilient wheel rotatably attached to the body; and a tread extending between the front wheel and the rear wheel, the tread including an interior circumferential surface and elements extending from the interior surface to define a recessed track in which at least a portion of at least one wheel travels, wherein the tread includes a ridge running longitudinally along an exterior surface of the tread and extending beyond all other portions of the tread.

17. The toy vehicle of claim 16, wherein the ridge is centered on the exterior surface of the tread.

18. The toy vehicle of claim 16, wherein the track is defined by a plurality of elements on opposite sides of the tread.

19. The toy vehicle of claim 16, wherein the elements are configured to engage at least one of the wheels.

20. The toy vehicle of claim 19, wherein at least one of the wheels includes cogs that are engaged by the elements.

21. The toy vehicle of claim 16, wherein the tread further comprises a rib running transversely along the width of the tread and extending beyond an exterior surface of the tread.

22. The toy vehicle of claim 16, wherein at least one of the wheels includes a plurality of tiers running longitudinally along the circumference of the wheel, and at least one of the tiers travels within the track defined by the tread.

23. The toy vehicle of claim 16, wherein each of the wheels has a diameter greater than a height of the body.

24. The toy vehicle of claim 23, wherein the front and the rear wheels extend, beyond the front and the rear of the body.

25. The toy vehicle of claim 16, further comprising at least one middle wheel that travels on the interior surface of the tread.

26. The toy vehicle of claim 25, wherein the middle wheel has a smaller diameter than do the front wheel and the rear wheel.

27. The toy vehicle of claim 16, further comprising a turret having a mechanism configured to launch projectiles.

28. A tread for a toy vehicle, the tread comprising:

a belt defining continuous interior and exterior surfaces, and projections extending from the interior surface to define a recessed track; and a narrow, central ridge running longitudinally along the exterior surface and extending beyond all other portions of the exterior surface.

29. A toy vehicle comprising:

a body;

a front wheel rotatably attached to the body;

a rear wheel rotatably attached to the body; and a tread extending between the front wheel and the rear wheel, wherein the wheels are resilient and the tread includes a ridge running longitudinally along an exterior surface of the tread and extending beyond all other portions of the tread.

* * * * *